US005421988A

United States Patent [19]

Ando et al.

[11] Patent Number: 5,421,988

[45] Date of Patent: Jun. 6, 1995

[54] METHOD OF MANUFACTURING PLATED STEEL SHEET WITH ZN-CR COMPOSITE PLATING

[75] Inventors: Satoru Ando; Takayuki Urakawa; Masaki Abe; Toyofumi Watanabe, all of Tokyo, Japan

[73] Assignee: NKK Corporation, Tokyo, Japan

[21] Appl. No.: 188,211

[22] Filed: Jan. 27, 1994

[30] Foreign Application Priority Data

Sep. 10, 1993 [JP] Japan ..... 5-225541

[51] Int. Cl.[6] ..... C25D 3/56

[52] U.S. Cl. ..... 205/155; 205/156; 205/243; 205/244; 205/287; 205/316; 205/319

[58] Field of Search ..... 205/155, 156, 243, 244, 205/287, 316, 319

[56] References Cited

U.S. PATENT DOCUMENTS 4,048,381 9/1977 Adaniya et al. ..... 428/632

FOREIGN PATENT DOCUMENTS 285931 10/1988 European Pat. Off. .
114686 7/1982 Japan ..... 205/155
64-55397 3/1989 Japan .
64-55398 3/1989 Japan .
64-79393 3/1989 Japan .
2-51996 11/1990 Japan .
3-240994 10/1991 Japan .
2100752 1/1983 United Kingdom .

OTHER PUBLICATIONS

Ryochi Naka et al, "Rust proofed steel plates with good corrosion resistance", Chemical Abstracts, vol. 116, No. 22, Jun. 1, 1992, Columbus, Ohio, p. 296, No. 219 060s of Jpn Kokai Tokkyo Koho JP 03 240 994.

Nobukazu Suzuki et al., "Electroplating of an iron-zinc alloy", Chemical Abstracts, vol. 110, No. 14, Apr. 3, 1989, Columbus Ohio, USA, p. 624, No. 123 849f of Jpn Kokai Tokkyo Koho JP 63 241 194.

Shigeru Unno et al., "Electrodeposition of zinc, alumina and chromium on steel strip", Chemical Abstracts, vol. 110, No. 10, Mar. 6, 1989, Columbus, Ohio, p. 311, No. 80 400h of Jpn Kokai Tokkyo Koho JP 63 157 900.

"Zinc-nickel alloy electroplating", Kawasaki Steel Corp., Chemical Abstracts, vol. 98, No. 26, Jun. 27, 1983, Columbus, Ohio, p. 546, No. 224 256z of Japan Kokai Tokkyo Koho JP 58 09 997.

*Primary Examiner*—John Niebling
*Assistant Examiner*—Edna Wong
*Attorney, Agent, or Firm*—Frishauf, Holtz, Goodman & Woodward

[57] ABSTRACT

There is disclosed a method of manufacturing a plated steel sheet with a Zn—Cr composite plating, wherein a total of 0.01 to 300 g/l of at least one type of salt having a pH buffering action in a pH range of 2 to 6 in a bath containing only zinc are added to an acidic Zn—Cr composite plating bath containing zinc ions and trivalent chromium ions to prepare a plating bath, and plating film is formed on a steel sheet using the resultant plating bath.

9 Claims, 1 Drawing Sheet

METHOD OF MANUFACTURING PLATED STEEL SHEET WITH ZN-CR COMPOSITE PLATING

BACKGROUND OF THE INVENTION

1. Field of the Invention

The present invention relates to a method of manufacturing a plated steel sheet with a Zn—Cr composite plating, which is preferably used for automobiles, excellent in corrosion resistance and glossiness.

2. Description of the Related Art

Various countermeasures have been taken for painting and vehicle body designs to increase the corrosion resistance of automobile bodies. A rustproof steel sheet is mainly used at present in view of reliability in rustproof performance over long periods of time.

Among rustproof steel plates, a zinc-plated steel sheet or a zinc alloy-plated steel sheet is most frequently used. However, the development of a thin corrosion-resistant steel sheet which is capable of satisfying both requirements of low cost and high corrosion resistance has been desired.

As the most promising coatings to achieve the above object, Zn—Cr composite platings disclosed in Jpn. Pat. Appln. KOKOKU Publication No. 2-51996 and Jpn. Pat. Appln. KOKAI Publication Nos. 64-55397, 64-55398, 64-79393, and 3-240994 are exemplified. In these Zn—Cr composite platings, the corrosion inhibition effect by Cr present in the coatings is typical to provide a high corrosion resistance. Such a Zn—Cr composite plating is not passivated and maintains a relative base potential. For this reason, the so-called sacrificing corrosion protecting action is valid for a long period of time, and the Zn—Cr composite plating has a high corrosion resistance in a situation where the underlying steel is exposed.

However, at a joint portion of a steel sheet, unlike a thick plating material, the Zn—Cr composite plating cannot be expected to fill the joint portion of a corrosion product. The joint portion of the steel sheet is exposed to a relatively severe, nonuniform environment in which dry and wet conditions alternate. Even if the Zn—Cr composite plating is formed on the steel sheet, the resultant steel product has a lower corrosion resistance than that of a hot-dip plated steel sheet with a thick plating film.

Although the Zn—Cr composite plating has a high potential for excellent corrosion resistance, no conventional coatings which manifest such performance have been proposed.

An oxide layer is present on the surface of a Zn—Cr composite plating according a conventional method. Glossiness is not necessarily satisfactory due to the oxide layer. Since the thickness of the oxide layer easily changes depending on manufacturing conditions, the surface oxide layer becomes thick depending on plating conditions, and the uppermost plating tends peel. In general, since a plated steel sheet is always pressed, there is a high possibility of a lead oxide remaining in a mold due to the large thickness of the oxide layer.

When the Zn—Cr composite plating is generally formed by cation electrodeposition coating in the field of automobiles, electrodeposition coating causes formation of a large number of abnormal discharge points to result in coating defects because the oxide layer on the surface of the coating of the Zn—Cr composite plating is nonuniform according to the conventional method.

As described above, a steel plate with a Zn—Cr composite plating according to the conventional method does not necessarily have satisfactory properties, and a manufacturing method which can solve these problems is demanded.

SUMMARY OF THE INVENTION

The present invention has been made in consideration of the above situation, and has as its object to provide a method of manufacturing a plated steel sheet with a Zn—Cr composite plating excellent in corrosion resistance, glossiness, workability, and coating property.

According to the present invention, there is provided a method of manufacturing a plated steel sheet with a Zn—Cr composite plating, comprising the steps of adding a total of 0.01 to 300 g/l of at least one type of salt having a pH buffering action in a pH range of 2 to 6 in an acidic Zn—Cr composite plating bath containing zinc ions and trivalent chromium ions to prepare a plating bath, and forming plating film on a steel sheet using the resultant plating bath.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
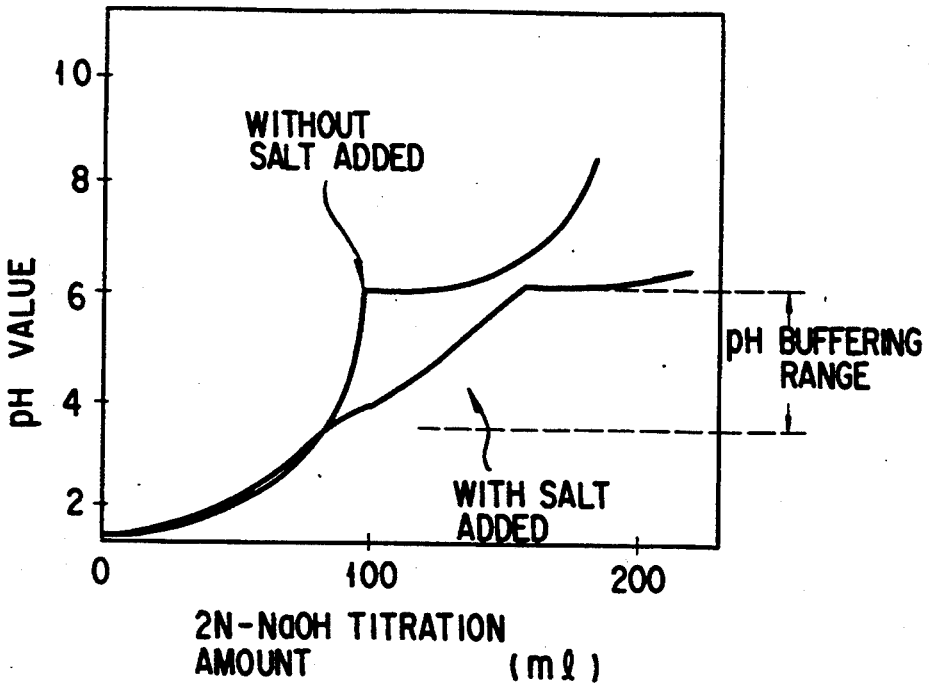
FIG. 1 is a graph showing a pH titration curve used to define a pH buffering action range of a salt having the pH buffering effect.
Figure 2:
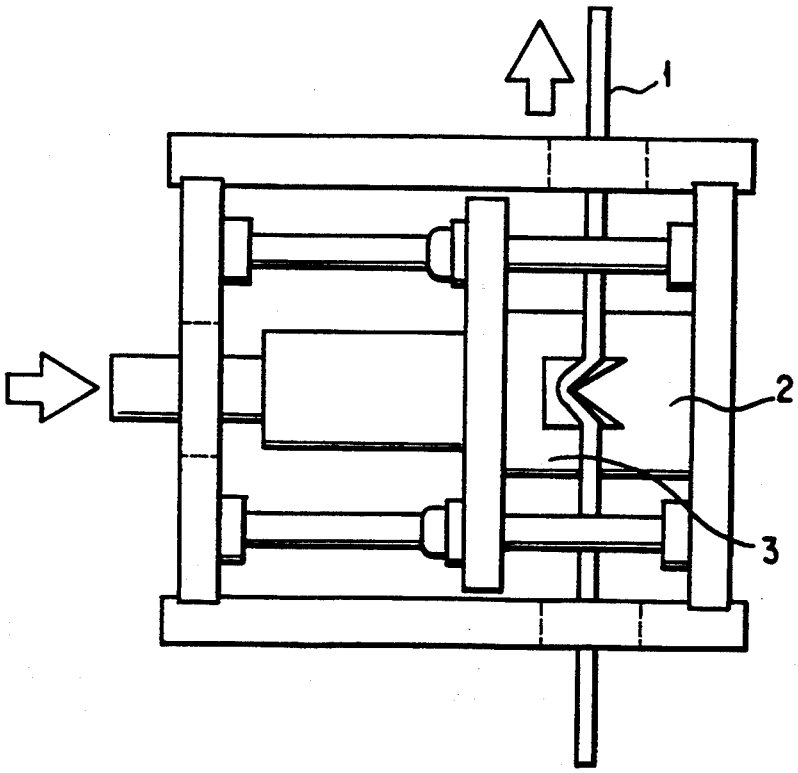
FIG. 2 is a sectional view showing an apparatus for conducting a draw bead test.

According to the present invention, a steel sheet is plated using a plating bath obtained such that a total of 0.01 to 300 g/l of at least one type of salt having a pH buffering effect in the pH range of 2 to 6 in a bath containing only zinc are added to an acidic Zn—Cr composite plating bath containing zinc ions and trivalent chronium ions to obtain a steel sheet with a Zn—Cr composite plating.

According to the corrosion protecting mechanism of the Zn—Cr composite plating, Cr present in a plating film becomes a stable oxide and to be present in a net-like shape during a corrosion process to hold a corrosion product, thereby suppressing a reaction. For this reason, homogeneous production of the Cr oxide is a key for the corrosion protecting mechanism.

The present inventors made studies on the prior arts described above with respect to this point. According to Jpn. Pat. Appln. KOKAI Publication Nos. 64-55398 and 64-79393, it is possible to obtain Zn—Cr plating films having high Cr contents. However, according to the studies of the present inventors, a nonuniform chromium area band having a width of 0.1 to 0.5 mm was present in the formed plating film. From the microscopic point of view, nonuniform chromium areas were distributed on the order of 10 μm, and a relatively thick oxide layer was nonuniformly formed as a surface layer.

The present inventors found that either nonuniformity of the composition or nonuniformity of the thickness of the surface oxide layer accelerated formation of corrosion start points, and these nonuniformities were succeeded in the corrosion process of the plating film and adversely affected the existing form of the Cr oxide which serves as an important factor for a high corrosion resistance of the Zn—Cr composite plating.

More specifically, the uniformity of the Cr oxide is degraded to reduce an effect of holding the corrosion product, and dissolution of the plating film tends to easily progress. Particularly, in a corrosive environment as in a joint portion, the environment greatly changes between dry and wet states, and corrosion start points are easily formed.

To the contrary, according to the method of the present invention having the above constitution, a salt having a pH buffering effect within the pH range of 2 to 6 is added in an appropriate amount. For this reason, very fine crystal grains can be obtained under general electrolytic conditions to reduce nonuniformity of the composition, and hardly any oxide layer is formed in the plating surface layer. In this manner, since the nonuniformity of the composition can be almost eliminated, a Zn—Cr composite plating can be obtained, in which corrosion start points are hardly formed and the corrosion resistance is high.

Since the oxide layer is hardly formed, a Zn—Cr composite plating excellent in glossiness workability, and coating property can be obtained.

The characteristic feature of the method of the present invention lies in that a total of 0.01 to 300 g/l of at least one type of salt having a pH buffering effect within the pH range of 2 to 6 in a bath containing only zinc are added to an acidic Zn—Cr composite plating bath containing zinc ions and trivalent chromium ions. According to this method, the crystal grains of the plating film become fine, and a nonuniform oxide layer is not formed in the surface layer of the plating film. This mechanism is not yet perfectly clarified but may be explained as follows.

In electrodeposition in a general acidic plating bath, hydrogen is produced to increase the pH at the cathode boundary. When the pH exceeds the critical pH for forming a hydroxide of trivalent chromium ions in the case of a Zn—Cr composite plating, a composite hydroxide formed of Zn and Cr is assumed to be formed. Therefore, it is assumed that, in a bath containing zinc ions and trivalent chromium ions as a Zn—Cr plating solution, a pH stop region is formed near a pH of 4 during formation of the hydroxide, and no pH stop region is formed at a pH of 5.5 as the pH for forming Zn hydroxide. If an increase in pH at the cathode boundary is nonuniform, formation of such a composite hydroxide becomes nonuniform accordingly. The Zn—Cr composite plating is regarded to be electrodeposited through this composite hydroxide. Since this hydroxide is nonuniformly left in the surface layer of plating film, the surface property is relatively nonuniform to result in a glossless plating.

To the contrary, when a salt having a pH buffering action, i.e., a pH buffering agent is added in the plating bath, an increase in pH at the cathode boundary and formation of a hydroxide are suppressed, and nonuniformity of a two-dimensional increase in pH is also suppressed. The hydroxide is not contained in the resultant film, and Zn and Cr can be discharged in a relatively free site. Therefore, a Zn—Cr composite plating having a very fine crystal grains in which an oxide layer is not left in the surface layer is obtained. The pH at which the Zn—Cr composite hydroxide is produced falls within the range of 3 to 5 although it changes depending on the concentrations of Zn and Cr ions. If the pH range of an added salt having a pH buffering action falls within the range of 2 to 6 in consideration of pH ranges in the initial and last formation periods of the Zn—Cr composite hydroxide, the added salt can effectively suppress the formation of the composite hydroxide. To the contrary, if the pH buffering range is less than 2 or exceeds 6, the added salt does not effectively suppress the formation of the composite hydroxide.

The range of pH buffering action of the added salt can be defined as follows. When sodium hydroxide having a predetermined concentration is added to a bath containing only zinc having a predetermined concentration and pH of 1, the pH increases. At this time, the titration amount and pH of sodium hydroxide are plotted to obtain a curve. The same plotting as above is performed to obtain a curve for a case wherein a salt having a pH buffering action is added to the same bath. This curve is compared with the above curve. The pH stop region observed upon addition of the salt is defined as the range having a pH buffering action. The bath containing only zinc is used because an increase in pH upon addition of sodium hydroxide is not stable due to formation of a composite hydroxide in the presence of Cr ions, and hence reproducibility of the pH titration curve obtained without addition of a salt having a pH buffering action cannot be sufficiently obtained. The pH titration curve is shown in FIG. 1. FIG. 1 shows that the pH buffering region of the added salt falls within the range of 4 to 6.

The added salt need not be limited to a specific one if the above condition is satisfied. An acetate (especially sodium acetate) is most effective because it has this action from the pH of 4 in a relatively small amount in the solution containing Zn and Cr. In addition, an oxalate (e.g., trihydrogen potassium dioxalate), a citrate (e.g., sodium citrate), and a phthalate (e.g., hydrogen potassium phthalate) are also preferable to obtain the same effect as described above. These carboxylates are preferable since they have a remarkable effect of improving fineness of the plating film. Although the reason for this effect is not yet clear, it is surmised that C is precipitated in the film in a very small amount and serves as an active component to achieve fineness of the film.

An organic gloss agent which is regarded to be effective for Cr precipitation is generally added in the Zn—Cr composite plating. It is also preferable to add an organic gloss agent in the method of the present invention. When such an organic gloss agent is added, the effect of the added salt having the pH buffering agent is enhanced. That is, the synergism of the salt having a pH buffering action and the organic additive further enhances the above effect. In this case, the organic gloss agent is not limited to a specific one. The examples of the organic gloss agent are polymers (e.g., polyethylene glycol, polyallyl amine, polypropylene glycol, and polyvinyl alcohol), amides (e.g., nicotine amide and benzamide), hide glue, gelatine, and a combination thereof to obtain the same effect as described above. According to the present invention, the organic gloss agent is not an indispensable component, and the present invention can be achieved in the absence of the organic gloss agent because the addition of the salt having a pH buffering action in an amount falling within the range of the present invention allows to produce a Zn—Cr composite plating having a relatively high Cr content. Even in a Zn—Cr composite plating having a relatively low Cr content of about 2 to 5 wt %, the effect of the present invention can be obtained due to uniformity of the film obtained upon adding a salt having a pH buffering action.

The total amount of added salts having a pH buffering action is 0.01 to 300 g/l to obtain a satisfactory effect. If the total addition amount is less than 0.01 g/l, a sufficient effect is not obtained. If the total addition amount exceeds 300 g/l, precipitation of Zn and Cr is adversely affected, and hence a Cr content effective to obtain for a high corrosion resistance cannot be assured.

The amounts of zinc ions and trivalent chromium ions and an organic gloss agent are not limited to specific ranges. The practical amount of each of the zinc ions and trivalent chromium ions is 0.01 to 2 mol/l, and the practical amount of the organic gloss agent is 0.01 to 100 g/l.

Sodium sulfate, ammonium sulfate, and the like for increasing the electric conductivity in the plating bath can be added unless they do not adversely affect the film. The plating solution preferably has a pH of 1 to 3. If the pH of the solution is less than 1, the electrolytic efficiency is degraded. If the pH of the solution exceeds 3, the trivalent chromium ions cannot be stably present. The temperature of the plating bath generally falls within the range of about 30° to 70° C., and the practical range of the plating current density is 10 to 200 A/dm$^2$. When the plating current density changes, Cr content in the Zn—Cr composite plating film changes. When the Zn/Cr ion ratio in the plating bath is optimized, the Cr content in the film can be controlled.

According to the method of the present invention, a Zn—Cr composite plating may be formed on or under a general Zn or Zn alloy plating. When a chromate is to be formed on a plated steel sheet with a Zn—Cr composite plating or an organic resin film is to be formed on the chromate film, the method of the present invention can be applied in the manufacture of the Zn—Cr composite plating. In this case, a film having a higher corrosion resistance can be obtained.

In practical applications of the present invention, the underlying steel sheet is not limited to a specific one. A general mild steel sheet, a general high tensile steel sheet, or a general anticorrosive steel sheet can be used.

EXAMPLES

The present invention will be described by way of its examples.

Plating baths used in examples and comparative examples are shown in Tables 1 and 2. Table 1 shows Examples 1 to 67 in the scope of the present invention, and Table 2 shows Comparative Examples 1 to 45 outside the scope of the present invention. Plating conditions except for the bath compositions were unified as much as possible, the current density was set to 70 to 100 A/m$^2$, the pH of each plating bath was set to 2.0, the bath temperature was set to 50° C., and the relative flow rate was set to 1.5 to 2.0 m/s.

TABLE 1

| | | Plating Bath Composition | | | | | | |
|---|---|---|---|---|---|---|---|---|
| | Sample No. | $Zn^{2+}$ (mol/l) | $Cr^{3+}$ (mol/l) | $Na^{+}$ (mol/l) | Anion | Organic Gloss Agent | Salt Having pH Buffering Action (g/l) | |
| Example | 1 | 0.2 | 0.1 | 0.2 | Sulfuric acid ion | a | A | 10 |
| | 2 | 0.2 | 0.1 | 0.2 | " | a | B | 10 |
| | 3 | 0.2 | 0.1 | 0.2 | " | a | C | 10 |
| | 4 | 0.2 | 0.1 | 0.2 | " | a | D | 10 |
| | 5 | 0.2 | 0.1 | 0.2 | " | a | E | 10 |
| | 6 | 0.2 | 0.1 | 0.2 | " | a | F | 10 |
| | 7 | 0.2 | 0.1 | 0.2 | " | a | G | 10 |
| | 8 | 0.2 | 0.1 | 0.1 | " | a | D | 0.01 |
| | 9 | 0.2 | 0.1 | 0.2 | " | a | D | 0.05 |
| | 10 | 0.2 | 0.1 | 0.2 | " | a | D | 0.5 |
| | 11 | 0.2 | 0.1 | 0.2 | " | a | D | 50 |
| | 12 | 0.2 | 0.1 | 0.2 | " | a | D | 70 |
| | 13 | 0.2 | 0.1 | 0.2 | " | a | D | 100 |
| | 14 | 0.2 | 0.1 | 0.2 | Sulfuric acid ion | a | D | 300 |
| | 15 | 0.9 | 0.3 | 0.1 | " | a | D | 10 |
| | 16 | 0.9 | 0.3 | 0.1 | " | a + b | D | 10 |
| | 17 | 0.9 | 0.3 | 0.1 | " | b | D | 10 |
| | 18 | 0.9 | 0.3 | 0.1 | " | c | D | 10 |
| | 19 | 0.9 | 0.3 | 0.1 | " | a + c | D | 10 |
| | 20 | 0.9 | 0.3 | 0.1 | " | d | D | 10 |
| | 21 | 0.9 | 0.3 | 0.1 | " | e | D | 10 |
| | 22 | 0.9 | 0.3 | 0.1 | " | f | D | 10 |
| | 23 | 0.9 | 0.3 | 0.1 | " | a | A | 15 |
| | 24 | 0.9 | 0.3 | 0.1 | " | a | A | 50 |
| | 25 | 0.9 | 0.3 | 0.1 | " | a | A | 250 |
| | 26 | 0.9 | 0.3 | 0.1 | " | a | B | 15 |
| | 27 | 0.9 | 0.3 | 0.1 | Sulfuric acid ion | a | B | 50 |
| | 28 | 0.9 | 0.3 | 0.1 | " | a | B | 250 |
| | 29 | 0.9 | 0.3 | 0.1 | " | a | C | 15 |
| | 30 | 0.9 | 0.3 | 0.1 | " | a | C | 50 |
| | 31 | 0.9 | 0.3 | 0.1 | " | a | C | 250 |
| | 32 | 0.9 | 0.2 | 0.1 | " | a | E | 15 |
| | 33 | 0.9 | 0.3 | 0.1 | " | a | E | 50 |
| | 34 | 0.9 | 0.3 | 0.1 | " | a | E | 250 |
| | 35 | 0.9 | 0.3 | 0.1 | " | a | B + D | 0.01 |
| | 36 | 0.9 | 0.3 | 0.1 | " | a | B + D | 5 |
| | 37 | 0.9 | 0.3 | 0.1 | " | a | B + D | 10 |

TABLE 1-continued

| Sample No. | Plating Bath Composition $Zn^{2+}$ (mol/l) | $Cr^{3+}$ (mol/l) | $Na^{+}$ (mol/l) | Anion | Organic Gloss Agent | Salt Having pH Buffering Action (g/l) | |
|---|---|---|---|---|---|---|---|
| 38 | 0.9 | 0.3 | 0.1 | " | a | B + D | 250 |
| 39 | 0.9 | 0.3 | 0.1 | " | a | C + F | 0.01 |
| 40 | 0.9 | 0.3 | 0.1 | Sulfuric acid ion | a | C + F | 5 |
| 41 | 0.9 | 0.3 | 0.1 | " | a | C + F | 10 |
| 42 | 0.9 | 0.3 | 0.1 | " | a | C + F | 250 |
| 43 | 1 | 0.5 | 0.4 | " | a | D | 0.5 |
| 44 | 1 | 0.5 | 0.4 | " | a | D | 10 |
| 45 | 1 | 0.5 | 0.4 | " | a | D | 50 |
| 46 | 1 | 0.5 | 0. 4 | " | b | D | 0.5 |
| 47 | 1 | 0.5 | 0.4 | " | b | D | 10 |
| 48 | 1 | 0.5 | 0. 4 | " | b | D | 50 |
| 49 | 1 | 0.5 | 0.4 | " | c | D | 0.5 |
| 50 | 1 | 0.5 | 0.4 | " | c | D | 10 |
| 51 | 1 | 0.5 | 0. 4 | " | c | D | 50 |
| 52 | 1 | 0.5 | 0.4 | " | d | D | 0.5 |
| 53 | 1 | 0.5 | 0.4 | Sulfuric acid ion | d | D | 10 |
| 54 | 1 | 0.5 | 0.4 | " | d | D | 50 |
| 55 | 1 | 0.5 | 0.4 | " | a | B + D + F | 10 |
| 56 | 1 | 0.5 | 0.4 | " | a | B + D + F | 20 |
| 57 | 1 | 0.5 | 0.4 | Chloride ion | a | D | 10 |
| 58 | 0.6 | 0.3 | 0.2 | " | a | D | 10 |
| 59 | 0.2 | 0.1 | 0.2 | " | a | D | 10 |
| 60 | 0.9 | 0.3 | 0.1 | " | a | D | 10 |
| 61 | 0.15 | 0.15 | 0.1 | Sulfuric acid ion | None | D | 10 |
| 62 | 0.15 | 0.15 | 0.1 | " | None | D | 50 |
| 63 | 0.15 | 0.15 | 0.1 | " | None | D | 30 |
| 64 | 0.6 | 0.3 | 0.2 | " | None | D | 50 |
| 65 | 0.48 | 0.12 | 0.1 | " | None | D | 50 |
| 66 | 0.48 | 0.12 | 0.1 | " | None | B | 30 |
| 67 | 0.5 | 0.25 | 0.1 | " | None | B | 30 |

TABLE 2

| | Sample No. | Plating Bath Composition $Zn^{2+}$ (mol/l) | $Cr^{3+}$ (mol/l) | $Na^{+}$ (mol/l) | Anion | Organic Gloss Agent | Salt Having pH Buffering Action (g/l) | |
|---|---|---|---|---|---|---|---|---|
| Comparative Example | 1 | 0.2 | 0.1 | 0.2 | Sulfuric acid ion | a | — | 0 |
| | 2 | 0.9 | 0.3 | 0.1 | " | a | — | 0 |
| | 3 | 0.9 | 0.3 | 0.1 | " | a + b | — | 0 |
| | 4 | 0.9 | 0.3 | 0.1 | " | b | — | 0 |
| | 5 | 0.9 | 0.3 | 0.1 | " | c | — | 0 |
| | 6 | 0.9 | 0.3 | 0.1 | " | a + c | — | 0 |
| | 7 | 0.9 | 0.3 | 0.1 | " | d | — | 0 |
| | 8 | 0.9 | 0.3 | 0.1 | " | e | — | 0 |
| | 9 | 0.9 | 0.3 | 0.1 | " | f | — | 0 |
| | 10 | 1 | 0.5 | 0.4 | " | a | — | 0 |
| | 11 | 1 | 0.5 | 0.4 | " | b | — | 0 |
| | 12 | 1 | 0.5 | 0.4 | " | c | — | 0 |
| | 13 | 1 | 0.5 | 0.4 | " | d | — | 0 |
| | 14 | 1 | 0.5 | 0.4 | Sulfuric acid ion | a | — | 0 |
| | 15 | 0.6 | 0.3 | 0.2 | " | a | — | 0 |
| | 16 | 0.2 | 0.1 | 0.2 | " | a | — | 0 |
| | 17 | 0.9 | 0.3 | 0.1 | " | a | — | 0 |
| | 18 | 0.2 | 0.1 | 0.2 | " | a | D | 0.005 |
| | 19 | 0.2 | 0.1 | 0.2 | " | a | D | 350 |
| | 20 | 0.9 | 0.3 | 0.1 | " | a | A | 0.005 |
| | 21 | 0.9 | 0.3 | 0.1 | " | a | A | 320 |
| | 22 | 0.9 | 0.3 | 0.1 | " | a | B | 0.005 |
| | 23 | 0.9 | 0.3 | 0.1 | " | a | B | 320 |
| | 24 | 0.9 | 0.3 | 0.1 | " | a | C | 0.005 |
| | 25 | 0.9 | 0.3 | 0.1 | " | a | C | 350 |
| | 26 | 0.9 | 0.3 | 0.1 | " | a | E | 0.005 |
| | 27 | 0.9 | 0.3 | 0.1 | Sulfuric acid ion | a | E | 350 |
| | 28 | 0.9 | 0.3 | 0.1 | " | a | B + D | 0.005 |
| | 29 | 0.9 | 0.3 | 0.1 | " | a | B + D | 350 |
| | 30 | 0.9 | 0.3 | 0.1 | " | a | C + F | 0.005 |
| | 31 | 0.9 | 0.3 | 0.1 | " | a | C + F | 350 |
| | 32 | 1 | 0.5 | 0.4 | " | a | D | 0.005 |
| | 33 | 1 | 0.5 | 0.4 | " | a | D | 320 |
| | 34 | 1 | 0.5 | 0.4 | " | b | D | 0.005 |
| | 35 | 1 | 0.5 | 0.4 | " | b | D | 320 |
| | 36 | 1 | 0.5 | 0.4 | " | c | D | 0.00 |
| | 37 | 1 | 0.5 | 0.4 | " | c | D | 320 |
| | 38 | 1 | 0.5 | 0.4 | " | d | D | 0.005 |
| | 39 | 1 | 0.5 | 0.4 | " | d | D | 350 |

TABLE 2-continued

| Sample No. | Plating Bath Composition $Zn^{2+}$ (mol/l) | $Cr^{3+}$ (mol/l) | $Na^{+}$ (mol/l) | Anion | Organic Gloss Agent | Salt Having pH Buffering Action (g/l) | |
|---|---|---|---|---|---|---|---|
| 40 | 0.2 | 0.1 | 0.2 | Sulfuric acid ion | a | H | 10 |
| 41 | 0.2 | 0.1 | 0.2 | " | a | I | 10 |
| 42 | 0.9 | 0.3 | 0.1 | " | a | H | 50 |
| 43 | 0.9 | 0.3 | 0.1 | " | a | I | 50 |
| 44 | 1 | 0.5 | 0.4 | " | a | H | 10 |
| 45 | 1 | 0.5 | 0.4 | " | a | I | 10 |

Salts having a pH buffering action in Tables 1 and 2 are shown in Table 3, and organic gloss agents in Tables 1 and 2 are shown in Table 4. Of all the salts shown in Table 3, salts A to G exhibited pH buffering actions in the pH range of 2 to 6 in baths each containing only zinc. The following method is used to determine a range having a pH buffering action. 2N sodium hydroxide was added to 500 ml of a 0.2M zinc sulfate zinc bath having an adjusted pH of 1 and not containing a salt having a pH buffering action, the pH of the resultant solution was measured with a glass electrode in each titration amount, and the titration amount and pH of sodium hydroxide were plotted, thereby obtaining a corresponding curve. The same plotting was performed for a case wherein each salt having a pH buffering action was added to the corresponding bath, and the resultant curve was compared with the above curve. The pH stop region observed upon addition of each salt was defined as a range having a pH buffering action. The pH ranges having a pH buffering actions are shown in Table 3. Note that H and I are salts outside the pH buffering range of 2 to 6 and serve as controls.

TABLE 3

| Symbol | Salt Having pH Buffering Action | pH Range of pH Buffering Action |
|---|---|---|
| A | Sodium loctate | 2–3 |
| B | Sodium citrate | 2–6 |
| C | Dihydrogen potassium citrate | 2–3 |
| D | Sodium acetate | 4–6 |
| E | Potassium acetate | 4–6 |
| F | Ammonium oxalate | 2–4 |
| G | Hydrogen potassium phthalate | 4–6 |
| H | Trihydrogen potassium dioxalate | 1–1.8 |
| I | Dihydrogen potassium phosphate | 6.1–7 |

TABLE 4

| Symbol | Gloss Agent |
|---|---|
| a | Polyethylene glycol |
| b | Polyamine (NITTO BOSEKI CO., LTD. PAS-A) |
| c | Benzamide |
| d | Nicotine amide |
| e | Gelatine |
| f | Hide glue |

The Cr contents, surface glossinesses, corrosion resistances, coating properties, and workabilities of the films obtained under the above conditions are shown in Tables 5 and 6. Of these tables, Table 5 shows the results of Examples 1 to 67, and Table 6 shows the results of Comparative Examples 1 to 45. The Cr content of each film was calculated by dissolving an acid in a plating film and analyzing Zn and Cr concentrations.

The surface glossiness was evaluated with the following evaluation references upon measurements complying with JIS Z-8741 (Gs (45°)):

| | |
|---|---|
| Glossiness less than 100 | x (unsatisfactory) |
| 100 or more or less than 150 | Δ (slightly unsatisfactory) |
| 150 or more or less than 200 | ○ (good) |
| 200 or more | ◎ (excellent) |

The corrosion resistance was evaluated by the corrosion resistance of noncoated flat sheets (bare corrosion resistance) and samples assumed to have a joint portion. The sample assumed to have a joint portion was obtained such that a sample having a size of 150×170 mm and a sample having a size of 100×50 mm were spot-welded with their plated surfaces being in contact with each other, chemical conversion treatment and electrodeposition were performed on the joint portion. Each sample was subjected to a predetermined number of cycles in the following corrosion acceleration test and then removed, and the maximum depth of corrosion was measured. In the sample assumed to have a joint portion, the sample was split into two sheets, and the depth of corrosion of each plated surface was measured.

Corrosion Acceleration Test:

a test in which a 24-hour cycle is defined as → 50° C. 85% RH → 50° C. 30% RH → left in room temperature → dipping in brine, and a predetermined number of cycles are performed.

EVALUATION METHOD

Bare Flat Sheet Corrosion Resistance

Maximum Depth of Hole After 60 Cycles

| | |
|---|---|
| less than 0.1 mm | ◎ (excellent) |
| 0.1 mm or more and less than 0.2 mm | ○ (good) |
| 0.3 mm or more and less than 0.4 mm | Δ (slightly unsatisfactory) |
| 0.4 mm or more | x (unsatisfactory) |

Corrosion Resistance of Joint Portion Maximum Depth of Hole After 120 Cycles

| | |
|---|---|
| less than 0.1 mm | ◎ (excellent) |
| 0.1 mm or more and less than 0.2 mm | ○ (good) |
| 0.3 mm or more and less than 0.4 mm | Δ (slightly unsatisfactory) |
| 0.4 mm or more | x (unsatisfactory) |

After phosphatization, a cation electrodeposition coating having a thickness of 20 μm was formed at an applied voltage of 300 V with instantaneous boosting, and the number of coating defects was counted to evaluate the coating properties.

| | |
|---|---|
| less than 3 defects/dm$^2$ | ○ (good) |
| 3 defects/dm$^2$ or more or less than 10 defects/dm$^2$ | Δ (slightly unsatisfactory) |
| 10 defects/dm$^2$ or more | x (unsatisfactory) |

Workability was examined in a draw bead test. A male die 2 having a horizontal projection with a predetermined length (40 mm) was set to oppose a female die 3 to sandwich a sample piece 1 having a width of 30 mm therebetween, and the sample piece 1 was pulled upward by 100 mm at a speed of 20 mm/min while being pressed at a pressure of 500 kgf. The same piece 1 was then removed, and oil components were removed from the surfaces of the sample piece 1 by a solvent. The sample piece was further subjected to peeling with a tape. Upon completion of this test, the weight of each sample was measured, and a peeling amount was measured in accordance with a difference between the weights before and after the test.

| Peeling Amount | |
|---|---|
| less than 1 g/m$^2$ | ◎ (excellent) |
| 1 g/m$^2$ or more or less than 3 g/m$^2$ | Δ (slightly unsatisfactory) |
| 3 g/m$^2$ or more | x (unsatisfactory) |

TABLE 5

| | Sample No. | Plating Film Cr Content (wt %) | Glossiness | Corrosion Resistance: Bar Corrosion resistance | Corrosion Resistance: Corrosion Resistance of Joint Portion | Coating Properties | Workability |
|---|---|---|---|---|---|---|---|
| Example | 1 | 10 | ○ | ◎ | ○ | ○ | ○ |
| | 2 | 12 | ◎ | ◎ | ◎ | ○ | ○ |
| | 3 | 11 | ◎ | ◎ | ◎ | ○ | ○ |
| | 4 | 13 | ◎ | ◎ | ◎ | ○ | ○ |
| | 5 | 10.5 | ◎ | ◎ | ◎ | ○ | ○ |
| | 6 | 8 | ○ | ◎ | ○ | ○ | ○ |
| | 7 | 9 | ◎ | ◎ | ○ | ○ | ○ |
| | 8 | 13 | ○ | ◎ | ○ | ○ | ○ |
| | 9 | 13 | ◎ | ◎ | ◎ | ○ | ○ |
| | 10 | 12.5 | ◎ | ◎ | ◎ | ○ | ○ |
| | 11 | 12.5 | ◎ | ◎ | ◎ | ○ | ○ |
| | 12 | 11 | ○ | ◎ | ◎ | ○ | ○ |
| | 13 | 8 | ○ | ◎ | ○ | ○ | ○ |
| | 14 | 7 | ○ | ◎ | ○ | ○ | ○ |
| | 15 | 12.5 | ◎ | ◎ | ◎ | ○ | ○ |
| | 16 | 12.5 | ◎ | ◎ | ◎ | ○ | ○ |
| | 17 | 12 | ◎ | ◎ | ◎ | ○ | ○ |
| | 18 | 10 | ○ | ◎ | ◎ | ○ | ○ |
| | 19 | 11.5 | ○ | ◎ | ◎ | ○ | ○ |
| | 20 | 8 | ○ | ◎ | ○ | ○ | ○ |
| | 21 | 8 | ○ | ◎ | ○ | ○ | ○ |
| | 22 | 9 | ○ | ◎ | ○ | ○ | ○ |
| | 23 | 12.5 | ○ | ◎ | ◎ | ○ | ○ |
| | 24 | 11 | ○ | ◎ | ◎ | ○ | ○ |
| | 25 | 8 | ○ | ◎ | ○ | ○ | ○ |
| | 26 | 13 | ◎ | ◎ | ◎ | ○ | ○ |
| | 27 | 10.5 | ◎ | ◎ | ◎ | ○ | ○ |
| | 28 | 9 | ○ | ◎ | ○ | ○ | ○ |
| | 29 | 12 | ◎ | ◎ | ◎ | ○ | ○ |
| | 30 | 12 | ◎ | ◎ | ◎ | ○ | ○ |
| | 31 | 9.5 | ○ | ◎ | ○ | ○ | ○ |
| | 32 | 12 | ◎ | ◎ | ◎ | ○ | ○ |
| | 33 | 12.5 | ◎ | ◎ | ◎ | ○ | ○ |
| | 34 | 9.8 | ○ | ◎ | ○ | ○ | ○ |
| | 35 | 12 | ○ | ◎ | ◎ | ○ | ○ |
| | 36 | 12 | ◎ | ◎ | ◎ | ○ | ○ |
| | 37 | 12 | ◎ | ◎ | ◎ | ○ | ○ |
| | 38 | 10.5 | ○ | ◎ | ◎ | ○ | ○ |
| | 39 | 12 | ○ | ◎ | ◎ | ○ | ○ |
| | 40 | 12 | ○ | ◎ | ◎ | ○ | ○ |
| | 41 | 12 | ◎ | ◎ | ◎ | ○ | ○ |
| | 42 | 10.5 | ○ | ◎ | ○ | ○ | ○ |
| | 43 | 12 | ◎ | ◎ | ◎ | ○ | ○ |
| | 44 | 12 | ◎ | ◎ | ◎ | ○ | ○ |
| | 45 | 11.5 | ◎ | ◎ | ◎ | ○ | ○ |
| | 46 | 12 | ◎ | ◎ | ◎ | ○ | ○ |
| | 47 | 12 | ◎ | ◎ | ◎ | ○ | ○ |
| | 48 | 11.5 | ◎ | ◎ | ◎ | ○ | ○ |
| | 49 | 10 | ○ | ◎ | ◎ | ○ | ○ |
| | 50 | 9.8 | ◎ | ◎ | ○ | ○ | ○ |
| | 51 | 8.9 | ◎ | ◎ | ○ | ○ | ○ |
| | 52 | 11.5 | ○ | ◎ | ◎ | ○ | ○ |
| | 53 | 10.4 | ◎ | ◎ | ◎ | ○ | ○ |
| | 54 | 9.8 | ◎ | ◎ | ◎ | ○ | ○ |
| | 55 | 11.5 | ◎ | ◎ | ◎ | ○ | ○ |
| | 56 | 10.5 | ◎ | ◎ | ◎ | ○ | ○ |
| | 57 | 12 | ◎ | ◎ | ◎ | ○ | ○ |
| | 58 | 10.8 | ◎ | ◎ | ◎ | ○ | ○ |
| | 59 | 12.5 | ◎ | ◎ | ◎ | ○ | ○ |

TABLE 5-continued

| Sample No. | Plating Film Cr Content (wt %) | Glossiness | Corrosion Resistance: Bar Corrosion resistance | Corrosion Resistance: Corrosion Resistance of Joint Portion | Coating Properties | Workability |
|---|---|---|---|---|---|---|
| 60 | 11.5 | ◎ | ◎ | ◎ | ○ | ○ |
| 61 | 4.5 | ○ | ○ | ◎ | ○ | ○ |
| 62 | 10.5 | ◎ | ◎ | ◎ | ○ | ○ |
| 63 | 12 | ◎ | ◎ | ◎ | ○ | ○ |
| 64 | 3.5 | ○ | ○ | ◎ | ○ | ○ |
| 65 | 3 | ○ | ○ | ◎ | ○ | ○ |
| 66 | 2.2 | ○ | ○ | ◎ | ○ | ○ |
| 67 | 2 | ○ | ○ | ◎ | ○ | ○ |

TABLE 6

| | Sample No. | Plating Film Cr Content (wt %) | Glossiness | Corrosion Resistance: Bar Corrosion resistance | Corrosion Resistance: Corrosion Resistance of Joint Portion | Coating Properties | Workability |
|---|---|---|---|---|---|---|---|
| Comparative Example | 1 | 10 | ○ | ◎ | ○ | ○ | ○ |
| | 2 | 13 | Δ | ○ | Δ | x | Δ |
| | 3 | 13 | Δ | ○ | Δ | x | x |
| | 4 | 12.5 | Δ | ○ | Δ | x | Δ |
| | 5 | 10.5 | Δ | ○ | Δ | x | Δ |
| | 6 | 11.9 | Δ | ○ | Δ | x | Δ |
| | 7 | 9.2 | Δ | Δ | x | x | Δ |
| | 8 | 9 | x | Δ | x | x | Δ |
| | 9 | 9.5 | Δ | Δ | x | x | Δ |
| | 10 | 12.5 | Δ | ○ | Δ | x | Δ |
| | 11 | 12.4 | Δ | ○ | Δ | x | Δ |
| | 12 | 10.9 | Δ | ○ | Δ | x | Δ |
| | 13 | 11.8 | Δ | ○ | Δ | x | Δ |
| | 14 | 12.5 | Δ | ○ | Δ | x | Δ |
| | 15 | 11.8 | Δ | ○ | Δ | x | Δ |
| | 16 | 12.8 | Δ | ○ | Δ | x | Δ |
| | 17 | 11.9 | Δ | ○ | Δ | x | Δ |
| | 18 | 13 | Δ | ○ | Δ | x | Δ |
| | 19 | 4.9 | x | x | x | Δ | Δ |
| | 20 | 12.5 | Δ | ○ | Δ | x | Δ |
| | 21 | 7.5 | Δ | Δ | x | x | Δ |
| | 22 | 13 | Δ | ○ | Δ | x | Δ |
| | 23 | 7 | Δ | Δ | x | x | Δ |
| | 24 | 12 | Δ | ○ | Δ | x | Δ |
| | 25 | 7.2 | Δ | Δ | x | x | Δ |
| | 26 | 12 | Δ | ○ | Δ | x | Δ |
| | 27 | 4.8 | x | x | x | Δ | Δ |
| | 28 | 12 | Δ | ○ | Δ | x | Δ |
| | 29 | 8.2 | Δ | Δ | x | x | Δ |
| | 30 | 12 | Δ | ○ | Δ | x | Δ |
| | 31 | 7.9 | Δ | Δ | x | x | Δ |
| | 32 | 12 | Δ | ○ | Δ | x | Δ |
| | 33 | 7.9 | Δ | Δ | x | x | Δ |
| | 34 | 12 | Δ | ○ | Δ | x | Δ |
| | 35 | 4.9 | x | x | x | Δ | Δ |
| | 36 | 10 | Δ | Δ | x | x | Δ |
| | 37 | 4.8 | x | x | x | Δ | Δ |
| | 38 | 11.5 | Δ | ○ | Δ | x | Δ |
| | 39 | 4.8 | x | x | x | Δ | Δ |
| | 40 | 13 | Δ | ○ | Δ | Δ | Δ |
| | 41 | 13 | Δ | ○ | Δ | Δ | Δ |
| | 42 | 12.5 | Δ | ○ | Δ | Δ | Δ |
| | 43 | 12.5 | Δ | ○ | Δ | Δ | Δ |
| | 44 | 12 | Δ | ○ | Δ | Δ | Δ |
| | 45 | 12 | Δ | ○ | Δ | Δ | Δ |

As can be apparent from the above tables, Examples 1 to 67 falling within the scope of the present invention were excellent in surface glossiness, corrosion resistance, coating properties, and workability.

To the contrary, the samples of Comparative Examples 1 to 17 which were plated using a bath not containing a salt having a pH buffering action were inferior in all the properties to those of examples plated using the bath containing salts having a pH buffering action in amounts defined in the claims under the same conditions as those of the examples. Therefore, the samples of Comparative Examples 1 to 17 were inferior in performance to those of the examples.

In the samples of Comparative Examples 18 to 39, the contents of salts having a pH buffering action fell outside the range defined in the claims, and these samples were inferior in all the properties to those obtained using the baths containing salts having a pH buffering action in amounts falling within the range defined in the claims. Samples 40 to 45 obtained from baths containing salts exhibiting pH buffering action in the pH range outside the present invention were inferior in all the properties to those obtained from the baths containing salts in amounts falling within the range defined in the claims of the present invention under the same conditions.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a plated steel sheet with a zinc-chromium composite plating, comprising the steps of:

adding a total of 0.01 to 300 g/l of at least one type of salt having a pH buffering action in a pH range of 2 to 6 in a bath containing only zinc to an acidic zinc-chromium composite plating bath containing zinc ions and trivalent chromium ions to prepare a plating bath, said salt having a pH buffering action suppressing an increase in pH at the cathode boundary, thereby suppressing the formation of hydroxide; and electroplating film on a steel sheet using the resultant plating bath.

2. A method according to claim 1, wherein the acidic zinc-chromium composite plating bath further contains an organic gloss agent.

3. A method according to claim 1, wherein the salt is a carboxylate.

4. A method according to claim 3, wherein the salt is a member selected from the group consisting of an acetate, an oxalate, a citrate, and a phthalate.

5. A method according to claim 4, wherein the salt is a member selected from the group consisting of sodium acetate, trihydrogen potassium dioxalate, sodium citrate, and hydrogen potassium phthalate.

6. A method according to claim 1, wherein an amount of zinc ions is 0.01 to 2 mol/l.

7. A method according to claim 1, wherein an amount of the trivalent chromium ions is 0.01 to 2 mol/l.

8. A method according to claim 2, wherein an amount of the organic gloss agent is 0.01 to 100 g/l.

9. A method according to claim 5 wherein the amount of zinc ions is 0.01 to 2 mol/l and the amount of chromium ions is 0.01 to 2 mol/l .

* * * * *